US011131073B2

(12) United States Patent
Rosponi

(10) Patent No.: US 11,131,073 B2
(45) Date of Patent: Sep. 28, 2021

(54) METHOD FOR FOUNDATION OF A TRANSFORMER PLATFORM AND TRANSFORMER PLATFORM WITH AT LEAST THREE PILES

(71) Applicant: Tractebel Overdick GmbH, Hamburg (DE)

(72) Inventor: Andreas Rosponi, Hamburg (DE)

(73) Assignee: Tractebel Overdick GmbH, Hamburg (DE)

( * ) Notice: Subject to any disclaimer, the term of this patent is extended or adjusted under 35 U.S.C. 154(b) by 0 days.

(21) Appl. No.: 16/285,585

(22) Filed: Feb. 26, 2019

(65) Prior Publication Data

US 2019/0264408 A1 Aug. 29, 2019

(30) Foreign Application Priority Data

Feb. 26, 2018 (DE) ..... 10 2018 104 329.5

(51) Int. Cl.

| | |
|---|---|
| ***E02B 17/00*** | (2006.01) |
| ***E02D 7/02*** | (2006.01) |
| ***E02D 27/52*** | (2006.01) |
| *E02B 17/02* | (2006.01) |

(52) U.S. Cl.

CPC ..... *E02B 17/00* (2013.01); *E02D 7/02* (2013.01); *E02D 27/525* (2013.01); *E02B 17/02* (2013.01); *E02B 2017/0043* (2013.01); *E02B 2017/0056* (2013.01)

(58) Field of Classification Search

CPC ..... E02B 17/02; E02B 2017/0039; E02B 2017/0043; E02B 2017/0056; E02B 17/00; E02D 27/525; E02D 7/02

See application file for complete search history.

(56) References Cited

U.S. PATENT DOCUMENTS

| | | | | |
|---|---|---|---|---|
| 5,219,451 A * | 6/1993 | Datta | E02B 17/024 | 405/203 |
| 5,522,680 A * | 6/1996 | Hoss | E02B 17/00 | 405/209 |
| 6,347,909 B1 * | 2/2002 | Kocaman | E02B 17/00 | 114/259 |
| 6,981,823 B2 * | 1/2006 | Roraas | E02B 17/00 | 405/195.1 |
| 2013/0183101 A1 * | 7/2013 | Vandenbulcke | E02D 13/04 | 405/204 |

FOREIGN PATENT DOCUMENTS

| | | |
|---|---|---|
| DE | 20 2009 006 507 U1 | 8/2009 |
| DE | 10 2010 046 732 A1 | 3/2012 |
| DE | 10 2016 116 166 A1 | 3/2018 |

* cited by examiner

*Primary Examiner* — Carib A Oquendo

(74) *Attorney, Agent, or Firm* — Bay State IP, LLC

(57) ABSTRACT

A method for foundation of a transformer platform having at least four piles (12), in which precisely one pile driver (1) is brought to the location, the pile driver (1) is supported on the seabed (9) by means of extendable supporting legs (7), driving jigs (11) are attached to the pile driver (1), the piles (12) are inserted through the associated driving jigs (11), the piles (12) are successively driven into the seabed (9) whilst maintaining the position of the pile driver (1), upper ends of the piles (12) driven into the seabed (9) are arranged level with or above the associated driving jig (11), the supporting legs (7) of the pile driver (1) are retracted and the pile driver (1) is moved away from the location.

8 Claims, 5 Drawing Sheets

METHOD FOR FOUNDATION OF A TRANSFORMER PLATFORM AND TRANSFORMER PLATFORM WITH AT LEAST THREE PILES

CROSS REFERENCE TO RELATED APPLICATION

This application claims priority to and takes the benefit of German Patent Application 10 2018 104 329.5 filed on Feb. 26, 2018, the contents of which are herein incorporated by reference.

BACKGROUND OF THE INVENTION

Field of the Invention

The invention relates to a method for foundation of a transformer platform and transformer platform with at least three piles. The invention also relates to the transformer platform, which is preferably installed by such a method and has at least three piles, and to a foundation for carrying out the method.

Description of the Related Art

Transformer platforms are necessary due to the expansion of wind power in the offshore sector. The current generated by the individual wind turbines is transformed on the transformer platforms and is brought to land from there by a cable. Transformer platforms or converter platforms are installed in particular in the North Sea off the west coast of Germany. The area is characterised by extremely high and energy-laden waves in comparatively shallow water. Known foundation structures such as jackets have a high degree of obstruction and therefore due to their design absorb high loads, so that they are heavy and as a result are expensive. It is known to provide pile foundations for transformer platforms, in the foundation of which a jig is arranged on the seabed and the piles are driven through the jig into the seabed. For this purpose a plurality of different pile drivers are used.

A disadvantage of the known driving method is that they do not function sufficiently precisely or they are relatively complex.

SUMMARY OF THE INVENTION

In a first aspect, the object of the present invention is to improve an aforementioned method for foundation of a transformer platform and, in a second aspect, to provide an improved transformer platform and, in a third aspect, to provide an improved foundation set which can provide a foundation for the transformer platform according to the invention.

The method according to the invention makes use of the idea of using precisely one pile driver which is brought to the location and is supported on the seabed by means of extendable supporting legs. The pile driver can be a jack-up platform or the like, which preferably has a crane and a hammer.

The term "driving" should be understood here very generally; for example, driving should also be understood as drilling. A pile driver can also be understood here as a drill or a drilling rig.

Jigs are attached to the pile driver. The jigs can be arranged externally or internally on a platform of the pile driver, the relative spacing of the jigs with respect to one another corresponds precisely to the position of the piles of the transformer platform on the seabed, and the piles are each individually driven successively and vertically into the seabed.

The piles are in each case inserted through an associated driving jig of the transformer platform. They are advantageously swung out vertically.

The piles are preferably driven successively into the seabed whilst the position of the pile driver is maintained. Preferably the supporting legs of the pile driver are not changed during the entire operation of driving all the piles. The piles driven into the seabed remain level with or above the driving jig associated with them. "Top" and "bottom" relate to orientations away from or towards the seabed.

It is also conceivable that a group of piles is driven into the seabed whilst the position of the pile driver is maintained and the pile driver is then reset and again a group of piles is driven into the seabed. Then the platform is placed onto all piles.

Next, the supporting legs of the pile driver are retracted and the pile driver with retracted supporting legs is moved away from the location. After being driven in, the upper ends of the piles project above the surface of the sea, preferably all at an identical height. The relative spacings of the upper ends of the piles relative to one another corresponds exactly to the relative spacings of supports of an upper platform part which is placed on top of the ends of the piles. Advantageously the piles are driven into the seabed until the upper ends are arranged at most at the height of the driving jig, preferably arranged+3 m, preferably +2 m, preferably up to +1 m, preferably +0.5 m, above the driving jig. The upper ends are not driven through the driving jig. The arrangement of the driving jigs corresponds exactly to the relative arrangement of the supports of the platform upper part and also the contact points of the piles with the seabed in a horizontal plane.

The upper platform part, which is brought to the location and at the location is placed onto the upper ends of the piles, is advantageously arranged on a framework which is arranged on a pontoon. When it is brought to the location the underside of the upper platform part has a height above the surface of the sea which is greater than the height of all the ends of the piles above the surface of the sea. The pontoon is lowered after the upper platform part has been moved above the piles and placed onto the ends of the piles. In this case the pontoon is arranged relative to the piles so that, when the upper platform part is lowered, supports on the underside of the upper platform part are located exactly on the ends of the piles.

In a second aspect the object is achieved by the above-mentioned transformer platform with the features of at least four piles which are driven parallel to one another into the seabed (9).

It is preferably installed by one of the above-mentioned methods, and conversely one of the above-mentioned methods is suitable for installation of the transformer platform.

The transformer platform has at least four piles which are driven parallel to one another into the seabed. The single structural connection between the piles is the upper platform part. Naturally, the piles are connected to one another in a certain way by means of the seabed, but within the context of the invention this is not a structural connection between the piles.

According to the invention the upper platform part rests on upper ends of the piles, and thus in particular the piles are not lowered laterally in guides or held laterally in guides of the upper platform part, but the platform has an underside with preferably upwardly closed receptacles which rest on the upper ends of the piles.

In the third aspect, the object is achieved by a foundation set for a transformer platform which initially consists of a pile driver. For example in the form of a lifting platform, and a pontoon with a framework.

The pile driver has arranged on it driving jigs which are fixed to one another. The relative arrangement of the driving jigs corresponds exactly to the arrangement of piles of the transformer platform in the installed state in a horizontal cross-section, that is to say the relative arrangement of the contact points of the piles with the seabed considered only in the horizontal extent. The driving jigs are preferably all arranged at the same height above the seabed on the fitted pile driver.

The pile driver advantageously has a hammer by which each of the piles can be driven through the associated driving jig into the seabed. The hammer is intended for driving all piles. The pile driver has supporting legs which make it possible to support the pile driver on the seabed at the location and thus to prevent a displacement of the pile driver during driving of the at least four, preferably five or any higher number of piles.

The supporting legs of the pile driver are all advantageously retractable and extendable. The extended supporting legs support a platform of the pile driver on the seabed, so that the platform can be lifted out of the sea by means of a jacking system or the like. With the supporting legs retracted, the pile driver is preferably floatable, so that it can be moved away from the location after the piles have been driven in.

Next the pontoon is moved with the upper platform part between the piles and is brought into position, so that above the ends of the piles the supports on the underside of the upper platform part for the piles are arranged exactly vertically above the ends of the piles. By lowering of the pontoon, for example by flooding of water tanks, the platform is lowered, and the supports are positioned exactly on the upper ends of the piles. Advantageously, the pile driver likewise has precisely the same number of driving jigs as piles.

The driving jigs can be adapted in their position for the respective transformer platform, i.e. their position on the pile driver can be changed. In their changed position they are then again arranged in a fixed position on the pile driver during the foundation work.

BRIEF DESCRIPTION OF THE DRAWINGS

The invention is described with reference to an exemplary embodiment in seven drawings. In the drawings.

Figure 2:
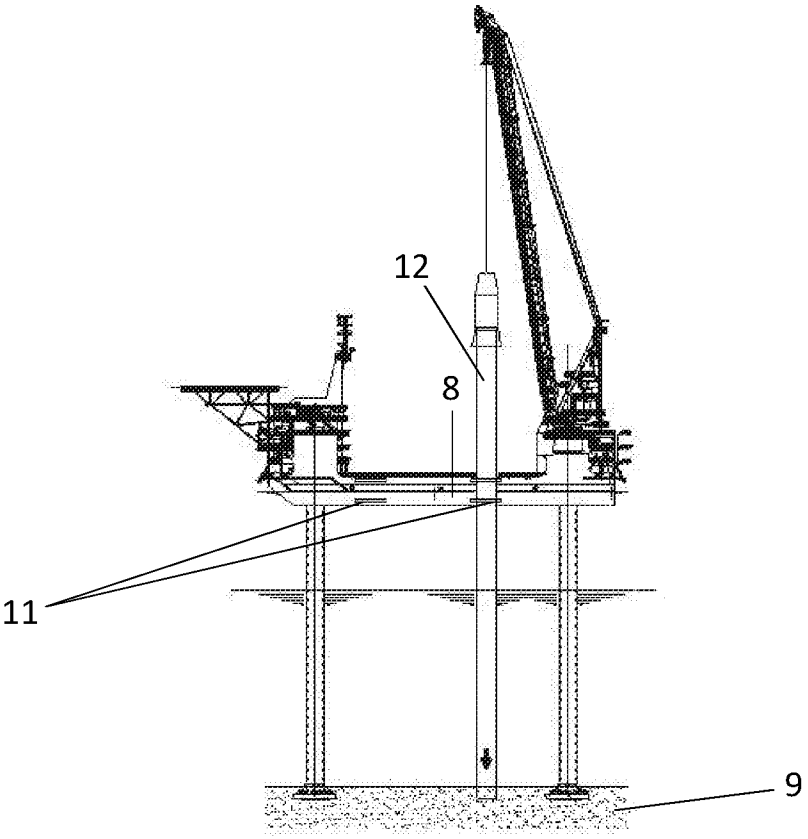
FIG. 2 shows a second step in which the pile is already driven some way into the seabed.

The methods according to the invention are described by way of example with reference to FIGS. 1 to 7.

DETAILED DESCRIPTION OF THE SEVERAL EMBODIMENTS

First of all the method according to the invention is described. It makes use of a foundation set which comprises a pile driver 1, for example in the form of a jack-up platform, as well as a pontoon 2 on which a framework 3 is arranged and on which in turn an upper platform part 4 of a transformer platform 6 to be installed can be arranged. First of all the pile driver 1 is brought to the location. The pile driver 1 itself can be floatable, and for this purpose it has retracted supporting legs 7 and a floatable platform 8.

However, the pile driver 1 can also be brought to the location by means of a barge or the like. The pile driver 1 is arranged in a predetermined manner at the location, i.e. in a predetermined orientation relative to the seabed 9, and then the supporting legs 7 of the pile driver 1 are lowered, so that the pile driver 1 is supported on the seabed 9. The platform 8 can be lifted out of the water by means of jacking systems.

Figure 1:
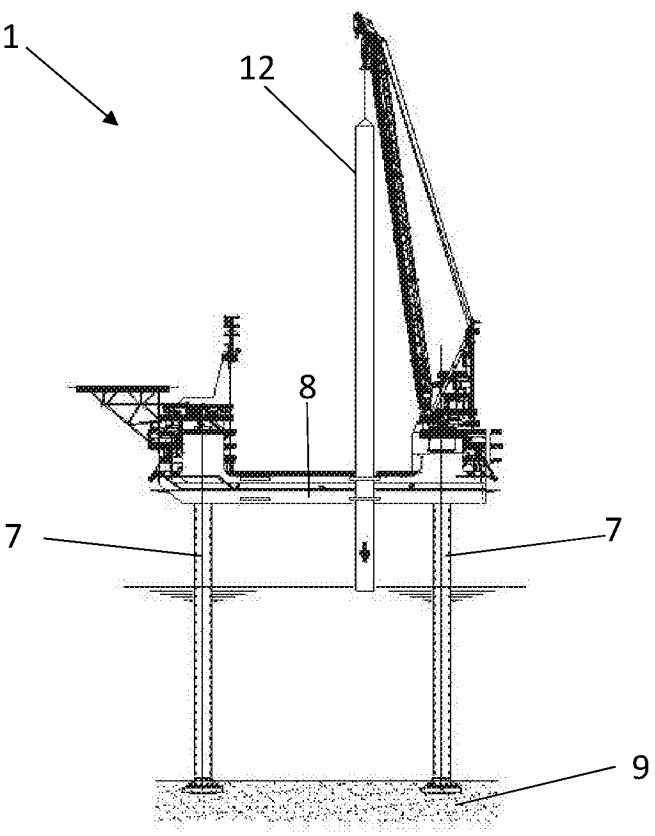
FIG. 1 shows a first step of a method according to the invention for foundation of a transformer platform by means of a jack-up platform which drives a pile of the transformer platform into the seabed.
Figure 4:
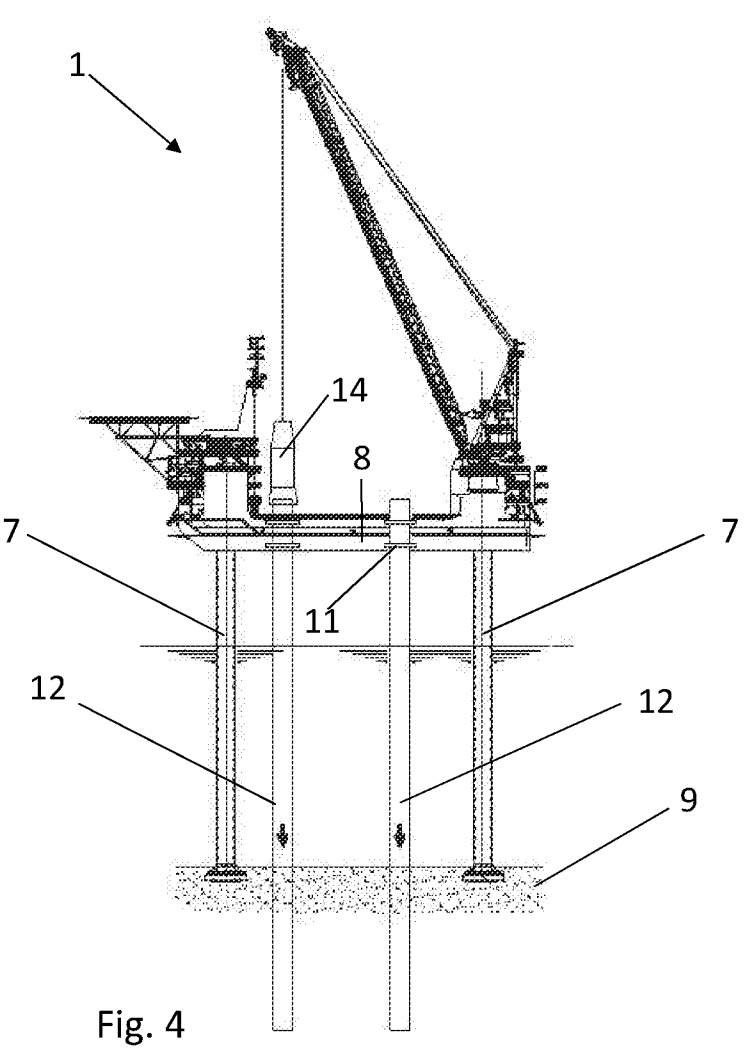
FIG. 4 shows a fourth step in which the second pile of the transformer platform is already completely driven into the seabed.
Figure 3:
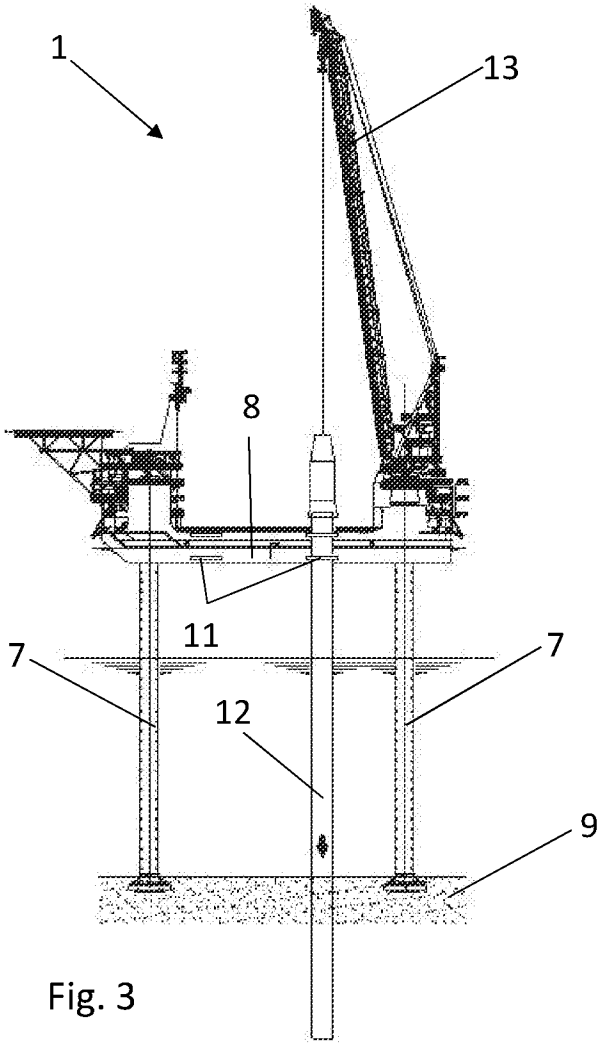
FIG. 3 shows a step of the method according to the invention in which the pile is already completely driven into the seabed.

According to FIG. 1, driving jigs 11 are arranged preferably laterally on the pile driver 1. The driving jigs 11 are arranged on the pile driver 1 in such a way that, when piles 12 are inserted vertically, the upper ends of the piles 12 are spaced apart from one another by precisely the spacing of supports on the underside of the upper platform part 4, so that the upper platform part 4 can be placed with its receptacles onto the upper ends of the piles 12 16.

In particular, no jig on the seabed 9 is necessary for foundation of the piles 12.

The pile driver 1 has a crane 13 with a hammer 14 according to FIGS. 1 to 4. This can involve a heavy weight. First of all by means of the crane 13 the first pile 12 is inserted through the first driving jig 11 until it is oriented vertically above the seabed 9, and then is lowered onto the seabed 9. It is placed vertically onto the seabed 9. The jigs 12 can be hinged and/or can also be detachable. Then by means of the hammer 14 the pile 12 is driven into the seabed 9. After a first pile 12 is driven in, the pile driver 1 remains at the predetermined position on the seabed 9, and a second pile 12 is inserted through a second driving jig 11, and by means of the hammer 14 the second pile 12 is driven into the seabed 9. As many piles 12 as are necessary for support of the upper platform part 4 are driven successively into the seabed 9. Four or any higher number of piles 12 can be driven in are being, preferably precisely four piles 12 are driven in. The piles 12 are driven into the seabed 9 to such an extent that the upper end is arranged at least level with the driving jig 11, preferably higher than the driving jig 11. Particularly preferably, the upper end of the pile 12 is level with the upper side of the driving jig 11 after the pile is driven into the seabed 9.

Figure 5:
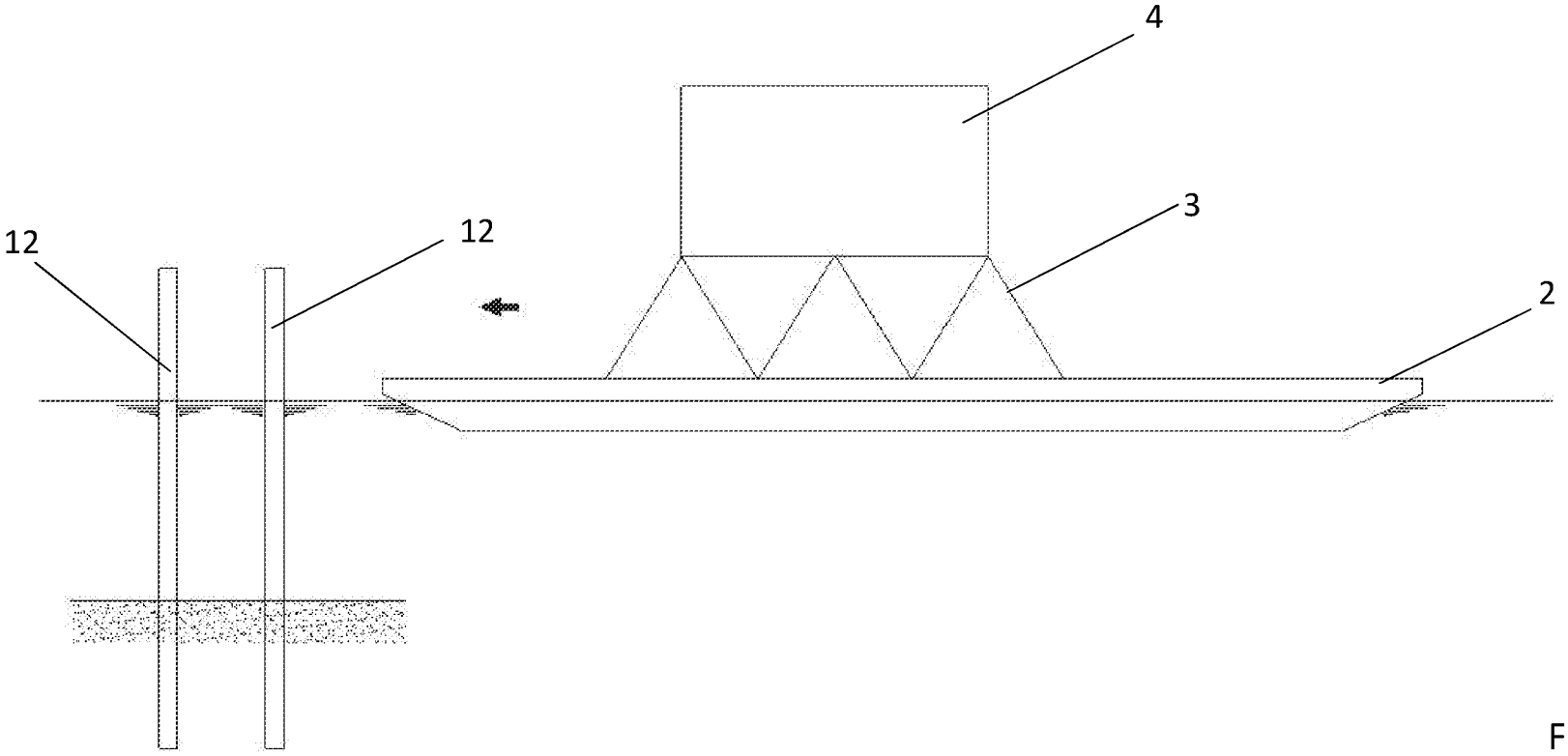
FIG. 5 shows a fifth step of the method according to the invention in which all the piles of the transformer platform are already driven into the seabed and an upper platform part is brought to the location by means of a pontoon.

After the piles 12 have been driven in, according to FIG. 5 they are all parallel to one another and vertical. First of all the upper platform part 4 is brought to the location. For this purpose the framework 3 or the like has previously been arranged on the pontoon 2. The framework 3 is a scaffold.

The upper platform part 4 is placed horizontally onto the framework 3. The pontoon 2 is also floatable together with the upper platform part 4 and is towed together with the upper platform part 4 to the location. This operation is illustrated in FIG. 5 and FIG. 6.

Figure 6:
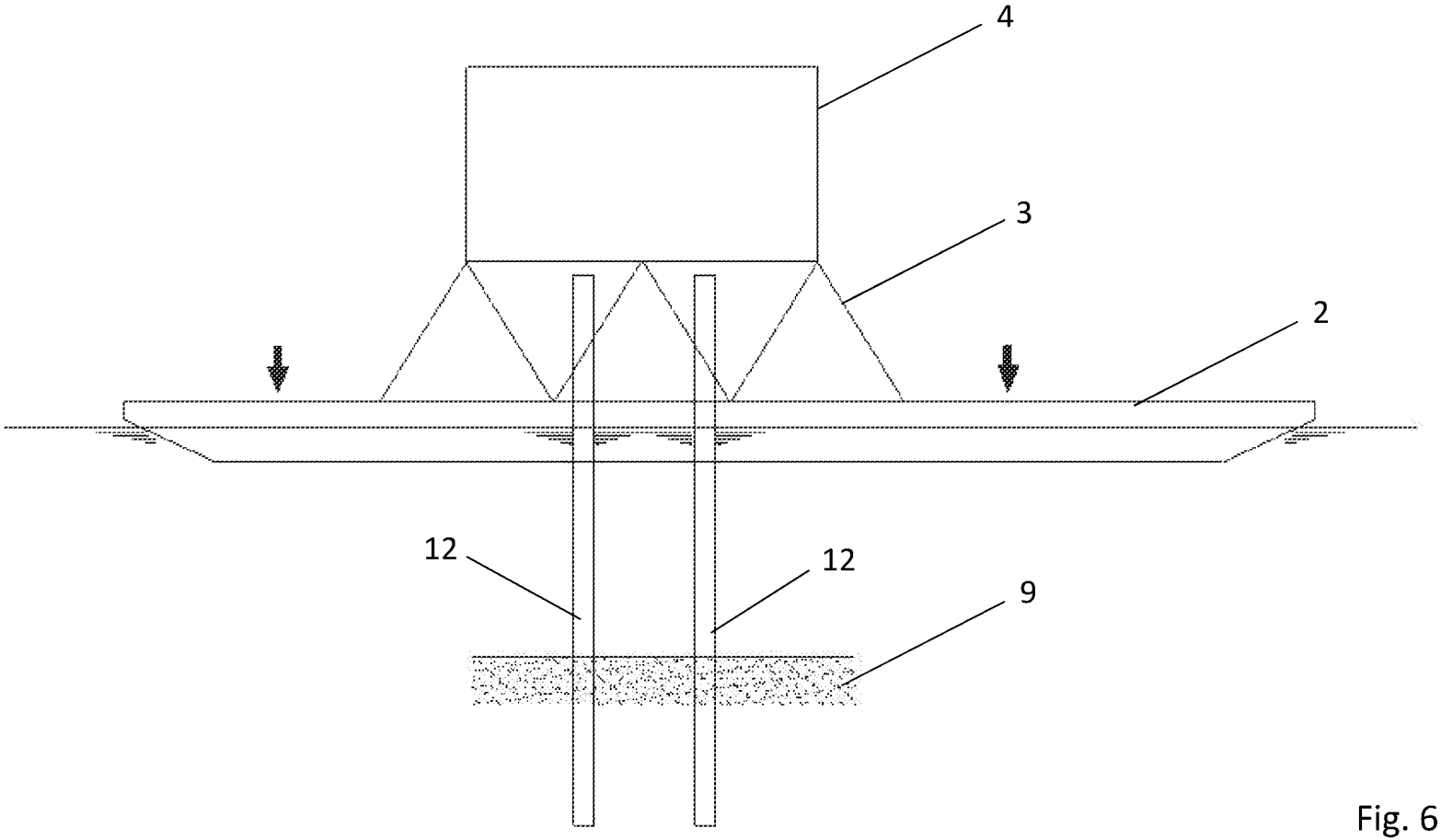
FIG. 6 shows a sixth step of the method according to the invention in which the upper platform part is brought by means of the pontoon above the ends of the driven piles and is lowered.

The pontoon 2 is dimensioned in such a way that according to FIG. 6 it passes through between the piles 12, and the upper platform part 4 is arranged on the framework 3 and on the pontoon 2 so that, as the pontoon 2 passes through, the upper platform part has a position relative to the piles 12 so that by the simple lowering of the upper platform part 4 the receptacles 16 on the underside of the upper platform part 4 are placed directly onto the upper ends of the piles 12.

The lowering of the pontoon 2 can take place by flooding of water tanks. The flooding is represented by two arrows in FIG. 6.

Figure 7:
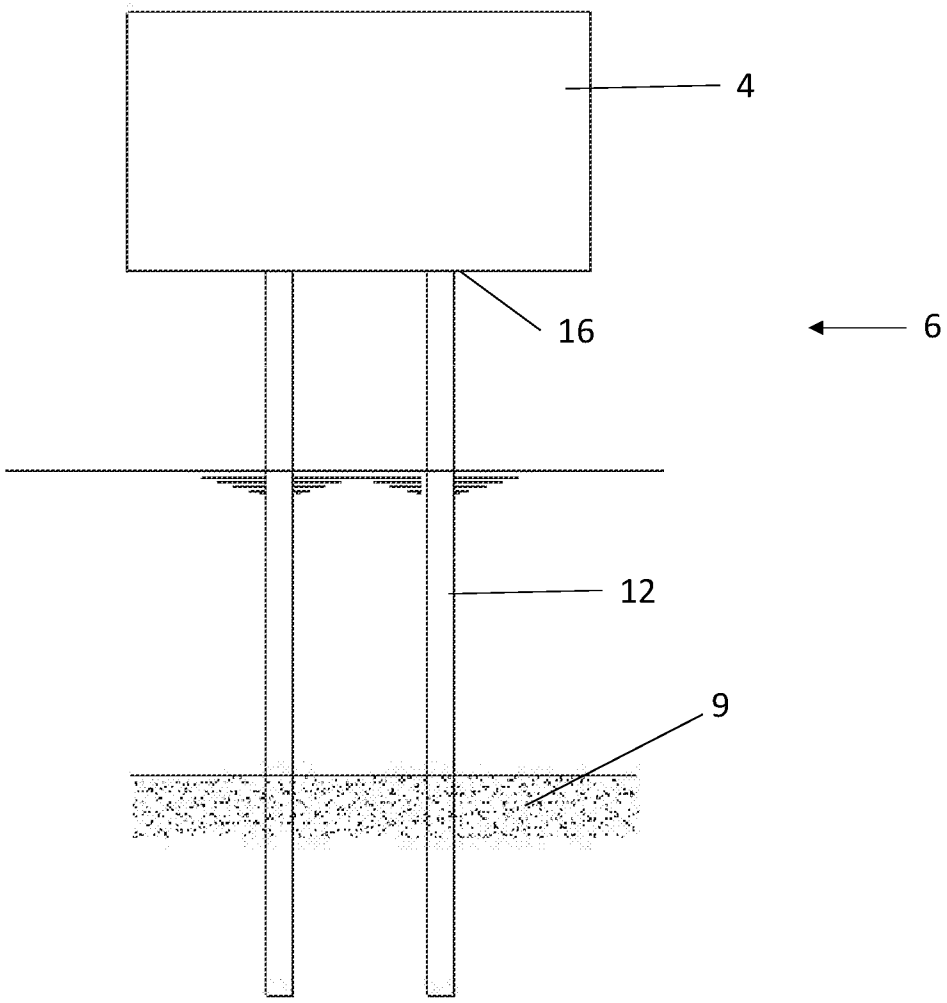
FIG. 7 shows the installed transformer platform with the upper platform part placed onto the piles.

FIG. 7 shows the finally installed transformer platform 6. The transformer platform 6 has relatively thin piles 12 which have no grid structure, so that the entire foundation body only has a very low degree of obstruction for the breaking of waves. Because of the low degree of obstruction the piles 12 can be designed with a small diameter.

What is claimed is:

1. Method for foundation of a transformer platform having at least four piles (12), in which precisely one pile driver (1) is brought to a location, the pile driver (1) is supported on a seabed (9) by means of extendable supporting legs (7), driving jigs (11) are attached to the pile driver (1), the piles (12) are inserted through the associated driving jigs (11), the piles (12) are successively driven into the seabed (9), upper ends of the piles (12) driven into the seabed (9) are arranged level with or above the associated driving jig (11), the supporting legs (7) of the pile driver (1) are retracted and the pile driver (1) together with the retracted supporting legs (7) is moved away from the location, and an upper platform part (4) is arranged on a pontoon (2) and is brought to the location, and at the location is placed onto the upper ends of the piles (12), wherein no jig on the seabed (9) is used.

2. Method according to claim 1, characterised in that the piles (12) are driven into the seabed (9) until the upper ends of the piles (12) are driven into the seabed (9) to the height of the driving jig (11) plus+3 m.

3. Method according to claim 1, characterised in that the upper platform part (4) is arranged on a framework (3) on the pontoon (2) and the underside of the upper platform part (4), when it is brought to the location, has a height above the surface of the sea which is higher than all upper ends of the piles (12) projecting above the surface of the sea and, after the upper platform part (4) is moved over the piles (12), the pontoon (2) is lowered until it is placed onto the upper ends of the piles (12).

4. Method according to claim 1, characterized in that the piles (12) are driven into the seabed (9) to the height of the driving jig (11) plus 1 m.

5. Method according to claim 1, characterized in that the piles (12) are driven into the seabed (9) to the height of the driving jig (11) plus 0.5 m.

6. Transformer platform, installed by the method of claim 1, containing at least four piles (12) which are driven parallel to one another into the seabed (9), wherein a single structural connection between the piles (12) is an upper platform part (4), characterised in that the upper platform part (4) is placed onto upper ends of the piles (12) and no jig on the seabed (9) is available.

7. Foundation set for a transformer platform containing a pile driver (1) which is supported on a seabed (9) at a location by means of extendable supporting legs (7), and the pile driver (1) has driving jigs (11) through which piles (12) of the transformer platform (6) can be inserted, and the pile driver (1) comprises a hammer (14) for driving all piles (12), and the supporting legs (7) of the pile driver (1) are retractable and the pile driver (1) together with the retracted supporting legs (7) can be moved away from the location, with a pontoon (2) which can be raised and lowered, and is provided with a framework (3) on which an upper platform part (4) is arranged, wherein a height of the framework (3) with the pontoon (2) raised is higher than all the upper ends of the piles (12) driven into the seabed (9) and no jig on the seabed (9) is available.

8. Foundation set according to claim 7, characterised in that on the pile driver (1) precisely the same number of driving jigs (11) are provided as the number of piles (12) necessary for the foundation of the transformer platform (6).

* * * * *